US011247261B2

(12) United States Patent
Beutel et al.

(10) Patent No.: US 11,247,261 B2
(45) Date of Patent: Feb. 15, 2022

(54) COLD ROLLING MACHINE AND METHOD FOR PRODUCING A PROFILE ON A WORKPIECE

(71) Applicant: OSG EX-CELL-O GmbH, Eislingen (DE)

(72) Inventors: Florian Beutel, Geislingen (DE); Oskar Schmitt, Süßen (DE); Michael Maier, Göppingen (DE); Alexander Metzger, Ebersbach (DE); Rafael Schweda, Ottenbach (DE)

(73) Assignee: OSG EX-CELL-O GMBH, Eislingen (DE)

( * ) Notice: Subject to any disclaimer, the term of this patent is extended or adjusted under 35 U.S.C. 154(b) by 0 days.

(21) Appl. No.: 17/251,986

(22) PCT Filed: May 29, 2019

(86) PCT No.: PCT/EP2019/064072
§ 371 (c)(1),
(2) Date: Dec. 14, 2020

(87) PCT Pub. No.: WO2019/238430
PCT Pub. Date: Dec. 19, 2019

(65) Prior Publication Data

US 2021/0245232 A1 Aug. 12, 2021

(30) Foreign Application Priority Data

Jun. 12, 2018 (DE) ..... 10 2018 113 978.0

(51) Int. Cl.
*B21H 3/06* (2006.01)
*B21H 5/02* (2006.01)
*B21H 3/04* (2006.01)

(52) U.S. Cl.
CPC ..... *B21H 3/06* (2013.01); *B21H 5/027* (2013.01); *B21H 3/04* (2013.01)

(58) Field of Classification Search
CPC ... B21H 1/18; B21H 3/02; B21H 3/04; B21H 3/06; B21H 5/02; B21H 5/027; B23G 7/02
(Continued)

(56) References Cited

U.S. PATENT DOCUMENTS 3,121,352 A * 2/1964 McCardell ..... B21H 5/027 72/374
4,229,966 A * 10/1980 Jackson ..... B21H 3/06 72/469
(Continued)

FOREIGN PATENT DOCUMENTS

DE 1552185 A1 9/1970
DE 10212256 A1 * 5/2003 ..... B21H 5/02
(Continued)

OTHER PUBLICATIONS

English Translation to International Search Report for Application No. PCT/EP2019/064072.
(Continued)

*Primary Examiner* — Edward T Tolan
(74) *Attorney, Agent, or Firm* — Cantor Colburn LLP

(57) ABSTRACT

A cold rolling machine and method for producing a profile on a workpiece. The cold rolling machine having two constructed tool units. Each tool unit has at least one rolling rod extending in the longitudinal direction, a tool slide, a slide drive device, a pivoting carrier and a pivot drive. The at least one rolling rod is fastened to the tool slide and can be moved in the longitudinal direction by the slide drive device. The pivoting carrier can be pivoted about a pivot axis extending in the longitudinal direction by a pivot drive. The
(Continued)

tool slide is arranged on the pivoting carrier. An angle of inclination can thereby be set between the two rolling rods, which angle of inclination can have, for example, a value of 0 degrees to 2.0 degrees or to 0.2 degrees. Conical profiles can thereby be produced in the workpiece.

20 Claims, 7 Drawing Sheets

(58) Field of Classification Search
USPC ..... 72/88, 406
See application file for complete search history.

(56) References Cited

U.S. PATENT DOCUMENTS

| | | | | | |
|---|---|---|---|---|---|
| 4,615,197 | A | * | 10/1986 | Allebach | B21H 3/06 72/88 |
| 4,941,339 | A | * | 7/1990 | Soehnlein | B21H 7/187 72/189 |
| 5,345,800 | A | * | 9/1994 | Smith | B21H 3/06 384/15 |
| 6,301,945 | B1 | | 10/2001 | Roseliep | |
| 7,051,565 | B2 | | 5/2006 | Kreissig et al. | |

FOREIGN PATENT DOCUMENTS

| | | | | | |
|---|---|---|---|---|---|
| DE | 10259665 | | | 7/2004 | |
| DE | 102005013746 | A1 | | 10/2005 | |
| DE | 102010008027 | A1 | | 8/2011 | |
| EP | 1286794 | | | 9/2004 | |
| GB | 651813 | A | * | 4/1951 | B21H 3/06 |
| GB | 1123753 | A | | 8/1968 | |
| JP | 55-68143 | A | * | 5/1980 | B21H 5/027 |
| JP | 59-206132 | A | * | 11/1984 | B21H 5/027 |

OTHER PUBLICATIONS

German Office Action for Application No. 10 2018 113 978.0.
International Search Report for Application No. PCT/EP2019/064072.
Written Opinion for Application No. PCT/EP2019/064072.
English Translation to Written Opinion for Application No. PCT/EP2019/064072; dated Oct. 18, 2019.

* cited by examiner

COLD ROLLING MACHINE AND METHOD FOR PRODUCING A PROFILE ON A WORKPIECE

CROSS REFERENCE TO RELATED APPLICATIONS

This application is a National Stage of PCT Application No. PCT/EP2019/064072 filed on May 29, 2019, which claims priority to German Patent Application No. DE 10 2018 113 978.0 filed on Jun. 12, 2018, the contents each of which are incorporated herein by reference thereto.

TECHNICAL FIELD

The invention refers to a cold rolling machine as well as a method for creating a profile on a workpiece by using of the cold rolling machine.

BACKGROUND

A cold rolling machine and a method for creation of a profile by means of the cold rolling machine are, for example, known from EP 1 286 794 B1.

During cold rolling at least a section of a workpiece is deformed and thereby a profile is created in the workpiece that extends in circumferential direction around the workpiece. The profile can be, e.g. a spur toothing. For example, the profile can be used to establish a torque-proof connection between the workpiece, e.g. a shank, and another component such as a toothed wheel. This torque-proof connection has to withstand the loads occurring during operation. For this reason the workpiece is usually hardened. The hardening is, however, only possible after the creation of the profile by cold rolling. In some workpieces this results in that a profile created during cold rolling does not have the desired dimensions after hardening. Particularly a conical deformation or a conical warp of the created profile can occur due to the hardening.

BRIEF SUMMARY

It can be considered as object of the present disclosure to provide a cold rolling machine and a method for creating a profile by means of which a profile can be created that corresponds to the dimensional requirements after hardening.

A cold rolling machine, including: a machine frame, the machine frame having two tool units, wherein each tool unit includes: at least one cold rolling rack having a cold rolling rack profile and extending along a longitudinal direction, a tool slide that carries the at least one cold rolling rack and that is linearly movably supported in longitudinal direction by a slide support device, a slide drive device that is configured to move the tool slide in the longitudinal direction, a pivoting carrier that is pivotably supported on the machine frame around a pivot axis and on which a slide support device and the tool slide with the at least one cold rolling rack is arranged, wherein the pivot axis extends in longitudinal direction, and a pivot drive that is configured to pivot the pivoting carrier with the tool slide and the at least one cold rolling rack such that the cold rolling rack profile of the cold rolling rack includes an inclination angle in a plane orthogonal to the longitudinal direction.

A method for creating a profile on a workpiece by using of a cold rolling machine, including: a machine frame, the machine frame having two tool units, wherein each tool unit includes: at least one cold rolling rack having a cold rolling rack profile and extending along a longitudinal direction, a tool slide that carries the at least one cold rolling rack and that is linearly movably supported in longitudinal direction by a slide support device, a slide drive device that is configured to move the tool slide in the longitudinal direction, a pivoting carrier that is pivotably supported on the machine frame around a pivot axis and on which a slide support device and the tool slide with the at least one cold rolling rack is arranged, wherein the pivot axis extends in longitudinal direction, and a pivot drive that is configured to pivot the pivoting carrier with the tool slide and the at least one cold rolling rack such that the cold rolling rack profile of the cold rolling rack includes an inclination angle in a plane orthogonal to the longitudinal direction, comprising the following steps: adjusting an inclination angle between the cold rolling rack of each tool unit in the plane orthogonal to the longitudinal direction, arranging of a section to be profiled of the workpiece between the cold rolling rack of each tool unit, and moving the cold rolling rack of each tool unit opposite to one another in longitudinal direction, wherein the cold rolling rack profile of each tool unit deform the section to be profiled of the workpiece.

According to the present disclosure, the cold rolling machine has a machine frame and two tool units. Each tool unit is arranged on the machine frame and preferably the two tool units are configured identically. Each tool unit has at least one cold rolling rack extending in a longitudinal direction and having a cold rolling rack profile. The cold rolling rack profiles of the cold rolling racks of the different tool units are facing each other. Each cold rolling rack is attached on a tool slide. The tool slide is linearly movably supported in longitudinal direction by means of a slide support device. A slide drive device is configured to move the tool slide in longitudinal direction.

In addition, each tool unit comprises a pivoting carrier. The pivoting carrier is pivotably supported around a pivot axis on the machine frame by means of a pivot support device. The pivot axis extends in longitudinal direction. A slide support device is arranged on the pivoting carrier on which the tool slide is supported that in turn carries the cold rolling rack.

By means of the pivoting drive of the tool unit, the pivoting carrier can be pivoted around the pivot axis. Also the cold rolling rack is thereby pivoted around the pivot axis together with the pivoting carrier. An inclination angle can be adjusted in a plane orthogonal to the longitudinal direction between the cold rolling rack profiles of the cold rolling racks of the two tool units due to the pivot movement around the respective pivot axis. If the amount of this inclination angle is unequal to zero, a profile is created in the workpiece that comprises a conicity according to the inclination angle.

The inclination angle in the cold rolling machine can be adjusted such that it compensates a conical deformation of the workpiece due to the subsequent hardening, at least partly, such that the workpiece has a conicity after hardening that is within a predefined tolerance range. A process-related created conicity of the profile can thus be compensated by means of the present disclosure in order to obtain a cylindrical profile. A conicity can be created due to hardening and/or for example, if the axial material flow is not symmetrical at the profile ends and/or due to different process forces. By means of the present disclosure also defined conical profiles can be created independent from the further processing of the workpiece.

It is advantageous, if the cold rolling machine comprises a control device for controlling the pivot drives of the tool units. The control device can be configured to pivot the pivoting carriers by equal pivot angle amounts around the assigned pivot axis respectively. Thereby a symmetrical alignment of the two tool units relative to a reference plane is created that extends along the longitudinal axis of the workpiece during creation of the profile, as well as parallel to the longitudinal direction.

It is also advantageous, if each pivot drive comprises a first wedge body having a first bevel surface inclined with regard to the longitudinal direction. The pivoting carrier of the respective tool unit can be supported at this first bevel surface on a support location. The support location is arranged with radial distance to the pivot axis. The first wedge body is movably or shiftably and particularly linearly shiftably supported in longitudinal direction. By shifting of the first wedge body the position of the support location along the first bevel surface changes, whereby a pivot movement of the pivoting carrier is effected. By converting or transferring the movement of the wedge body in longitudinal direction into a pivot movement, a very precise adjustment of the pivot angle can be achieved, particularly with small wedge angle amounts. Preferably the wedge angle of the first bevel surface relative to the longitudinal direction is smaller than 5 degrees or smaller than 3 degrees. In an embodiment the wedge angle of the first bevel surface has an amount of about 2 degrees.

In a preferred embodiment a pivoting carrier can be moved by a pivot angle around the pivot axis, wherein the amount of the pivot angle is at most 2.0 degrees or at most 1.0 degrees or preferably at most 0.2 degrees.

It is also advantageous, if each pivot drive comprises a second wedge body having a second bevel surface that is inclined with regard to the longitudinal direction. The second wedge body is arranged on or attached to the pivoting carrier. The second bevel surface is in two-dimensional abutment with the first bevel surface. In doing so, the distributed load can be lowered.

In a preferred embodiment the first wedge body is arranged on a rotatably supported shank. The shank can be linearly movably supported in longitudinal direction on the machine frame. For example, the pivot drive can comprise a screw drive by means of which the shank can be moved in longitudinal direction.

It is also advantageous, if the pivoting carrier comprises an L-shaped form in a plane orthogonal to the longitudinal direction.

Preferably a support body is movably supported in a height direction on the pivoting carrier. The height direction is orientated orthogonal to the longitudinal direction and orthogonal to the transverse direction. Thereby the tool slide can be movably arranged on the support body. The slide drive device can be movably supported at the pivoting carrier in height direction together with the support body. In doing so, a unit is created comprising the cold rolling rack, the tool slide, as well as the tool drive device that is movably arranged on the pivoting carrier. The pivoting carrier and the unit are in turn pivotably supported around the pivot axis.

It is further advantageous, if an adjustment drive is present that moves the support body in height direction relative to the pivoting carrier. Thereby the height adjustment can be carried out by means of the adjustment drive.

In an embodiment the adjustment drive can comprise a third wedge body having a third bevel surface inclined relative to the longitudinal direction. The third wedge body is preferably movably supported on the pivoting carrier. The support body is supported directly or indirectly on the third wedge body or the third bevel surface.

In an embodiment a fourth wedge body can be arranged or attached on the support body. The fourth wedge body has a fourth bevel surface that is inclined relative to the longitudinal direction. The fourth bevel surface can be in two-dimensional abutment against the third bevel surface. By shifting the third and the fourth wedge body relative to each other, particularly by shifting the third wedge body in longitudinal direction, the support body can be moved in height direction and can preferably be linearly shifted relative to the pivoting carrier.

In a preferred embodiment the slide drive device of the cold rolling machine comprises a drivable pinion. The pinion can be drivingly connected with a slide drive motor. The pinion is engaging a toothed rack. The toothed rack extends in longitudinal direction and is arranged or attached on the tool slide. During a rotation of the pinion the toothed rack moves together with the tool slide in longitudinal direction.

Any embodiment of the cold rolling machine described above can be used to create a profile in a section of the workpiece that is to be profiled.

For this first an inclination angle between the cold rolling rack profiles is adjusted in the plane orthogonal to the longitudinal direction. The section of the workpiece to be profiled is subsequently arranged between the cold rolling racks or the cold rolling rack profiles. The cold rolling racks are moved in longitudinal direction respectively opposite to each other. Thereby the cold rolling rack profiles engage into the section of the workpiece to be profiled and deform it in order to create the desired profile. Thereby the workpiece rotates around its longitudinal axis and rolls off the cold rolling rack profiles so to speak.

Subsequently at least the profile section of the workpiece can be hardened. Preferably a conicity of the created profile is measured and compared with a tolerance range directly after creation of the profile and/or after hardening. Even though the profile has to comprise a defined conicity directly after cold rolling—the defined conicity can also be a cylindrical profile, i.e. a conicity equal to zero—the created profile can be measured in the non-hardened condition and compared with a tolerance range. If the determined conicity is within the tolerance range directly after creation of the profile and/or after hardening, the cold rolling machine or the inclination angle is adjusted correctly and further workpieces can be manufactured. If the determined conicity is outside the tolerance range, an inclination angle change is determined based on the deviation and the inclination angle is changed about the determined inclination angle change. Usually it is sufficient to determine the conicity after the production of one single workpiece and to determine and adjust the required inclination angle therefrom. The further similar workpieces can be manufactured with this adjustment without resulting in increased waste parts numbers due to conicity deformation during hardening.

BRIEF DESCRIPTION OF THE FIGURES

Preferred embodiments of the present disclosure are apparent from the dependent claims, the description and the drawings. In the following preferred embodiments of the present disclosure are explained in detail. The drawings show:

DETAILED DESCRIPTION

Figure 1:
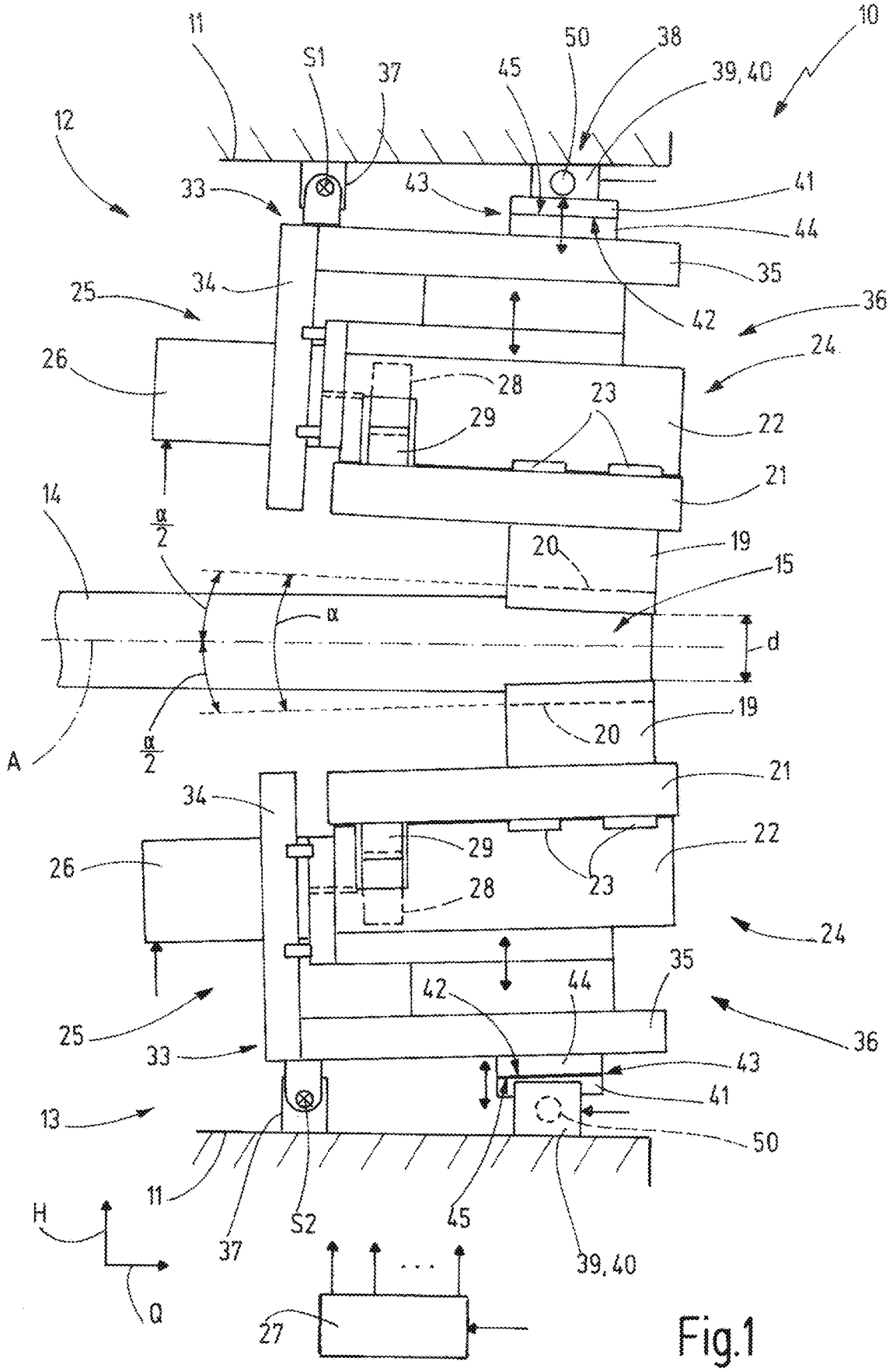
FIG. 1 a schematic block diagram-like illustration of an embodiment of a cold rolling machine, FIG. 2 an embodiment of a cold rolling machine in a perspective illustration, FIG. 3 a cold rolling machine of FIG. 2 in a cut illustration orthogonal to a longitudinal direction, FIG. 4 the cold rolling machine of FIGS. 2 and 3 in a cut illustration orthogonal to a transverse direction, FIG. 5 the cold rolling machine according to FIGS. 2-4 in a front view, FIG. 6 an enlarged illustration of a pivot drive in a tool unit in the area VI in FIG. 5 and FIG. 7 an embodiment of a method for creation of a profile on a workpiece.
Figure 2:
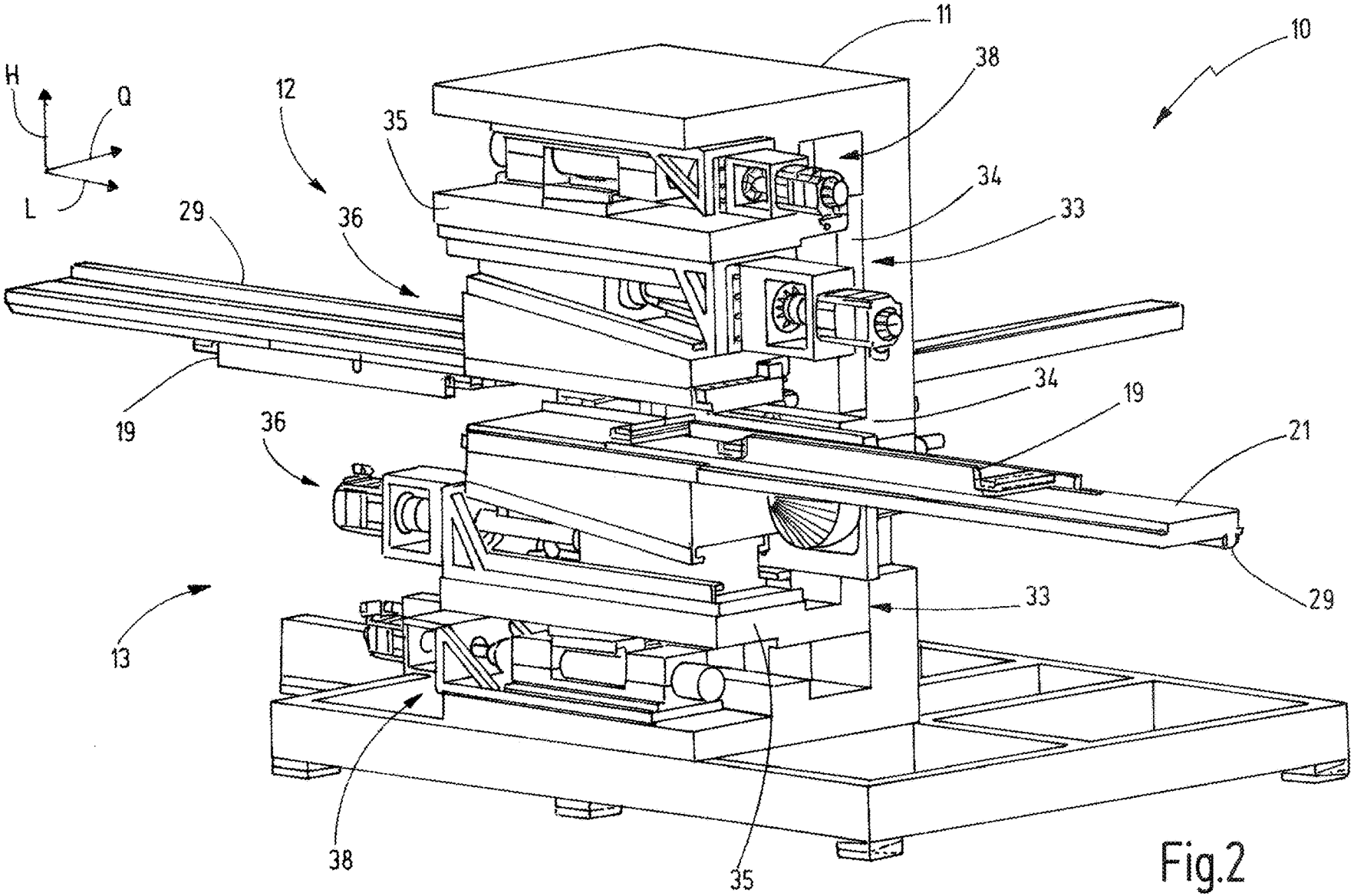
Figure 3:
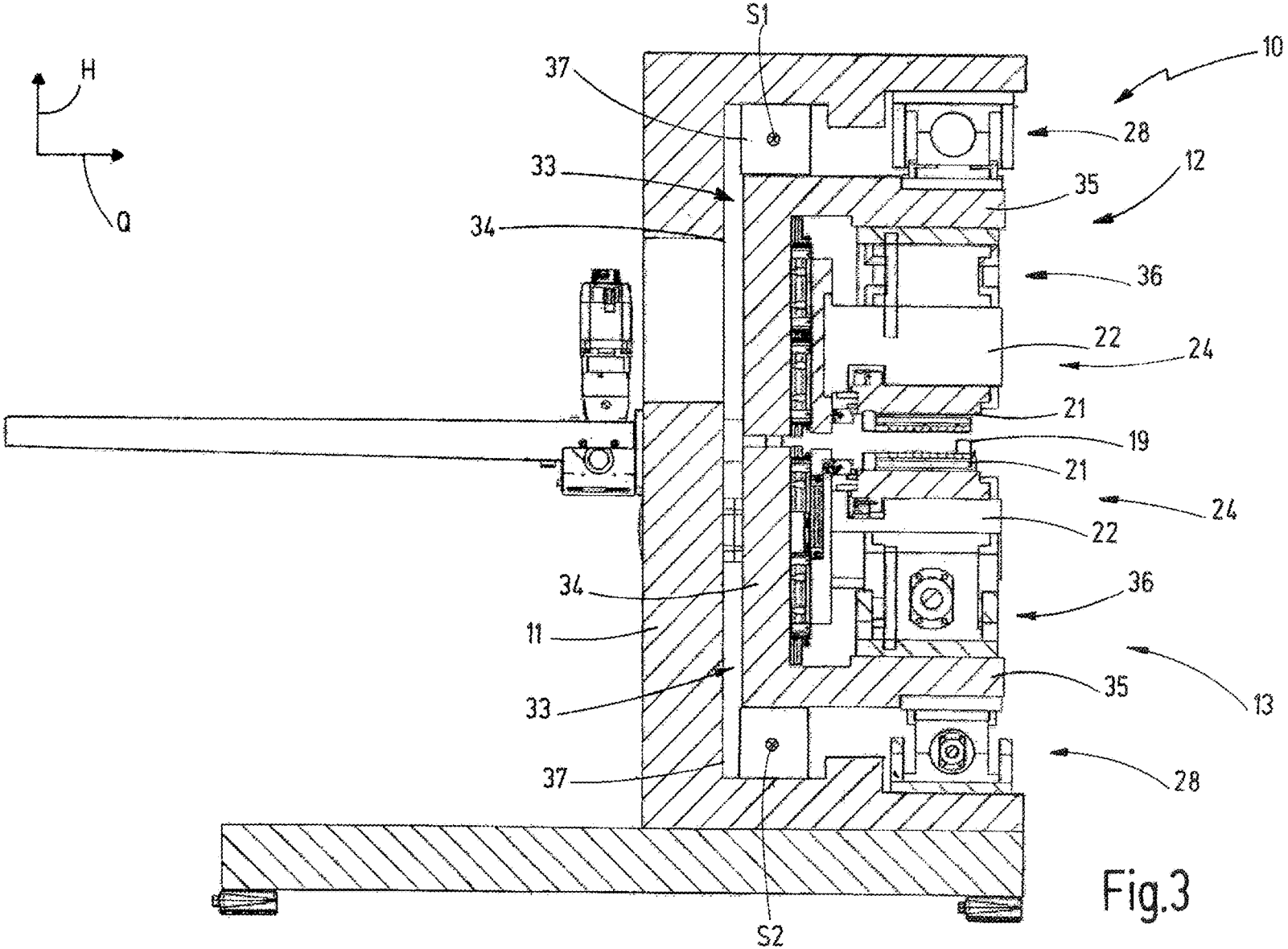

FIG. 1 illustrates a block diagram of an embodiment of a cold rolling machine 10. The cold rolling machine has a machine frame 11 that is only schematically shown, on which a first tool unit 12 and a second tool unit 13 are arranged. The two tool units 12, 13 are identically configured in the embodiment and are diametrically opposed to one another with reference to a longitudinal axis A of a workpiece 14 to be profiled. The workpiece 14 has at least one section 15 to be profiled that is circularly cylindrically configured in cross-section of the workpiece 14 in the initial condition. The section to be profiled can be cylindrically or conically prior to creating the profile. On the circumference of the section 15 to be profiled a profile is created by means of the cold rolling machine 10 by cold forming.

Each tool unit 12, 13 has a cold rolling rack 19 with a cold rolling rack profile 20. The cold rolling rack profiles 20 of the two cold rolling racks 19 are facing each other. The cold rolling rack 19 of each tool unit 12, 13 is releasably attached on a respective tool slide 21. The tool slide 21 is movably supported in a longitudinal direction L on a support body 22. For this at least one and according to the example, two plain bearing elements 23 having a plain bearing surface in each case can be provided on the support body 22 on which the tool slide 21 is supported, for this purpose.

The longitudinal direction L is orientated orthogonal to the drawing plane in FIG. 1. A transverse direction Q extends orthogonal to the longitudinal direction L, wherein the longitudinal axis A of the workpiece 14 is orientated parallel to the transverse direction Q. A height direction H extends orthogonal to the longitudinal direction L and the transverse direction Q. The two cold rolling racks 19 or cold rolling rack profiles 20 have a profile distance d in height direction H, wherein the profile distance d defines the minimum distance between the two cold rolling racks 19 in the plane of the longitudinal axis A of the workpiece according to the example.

In the described embodiment a slide support device 24 for the tool slide 21 is formed by the support body 22 and the plain bearing elements 23 according to the example. In modification thereto instead of a plain bearing, the slide support device 24 could also provide a roller bearing for the tool slide 21.

The tool slide 21 is movable in longitudinal direction L relative to the slide support device 24 and according to the example, relative to the support body 22 by means of a slide drive device 25. In the embodiment the slide drive device 25 has a slide drive motor 26 that can be controlled by means of a control device 27. The slide drive motor 26 is drivingly coupled with a pinion 28. For example, the pinion 28 can be directly arranged in a torque-proof manner on a drive shank of the slide drive motor 26. The pinion 28 is in engagement with a toothed rack 29. The toothed rack 29 is attached to the tool slide 21 and extends in longitudinal direction L. According to the example, it is arranged on the side of the tool slide 21 opposite the cold rolling rack 19. On this side the tool slide 21 is supported on the slide support device 24 and according to the example, the plain bearing elements 23.

When driving the slide drive motor 26, the pinion 28 rotates and the toothed rack 29 is moved in longitudinal direction L along the slide support device 24 together with the tool slide 21. The slide support device 24 can have suitable means for guiding of the tool slide 21.

Each tool unit 12, 13 comprises in addition a pivoting carrier 33. In the embodiment described here the pivoting carrier 33 has an L-shaped form with a first leg 34 and a second leg 35 that are connected to each other in a corner area. On the first leg 34 the slide support device 24 is movably supported together with the slide drive device 25 along the first leg 34. The first leg 34 extends originating from the connection area with the second leg 35 substantially in height direction H, but can also extend slightly inclined relative to the height direction H depending on the orientation of the pivoting carrier 33, which will be explained in the following. The second leg 35 extends originating from the connection area with the first leg 34 substantially in transverse direction Q. In the embodiment illustrated here the two legs 34, 35 are orientated orthogonal to one another.

In the embodiment an adjustment drive 36 is arranged between the pivoting carrier 33 and the slide support device 24, by means of which the slide support device 24 and the slide drive device 25 can be linearly shifted together along or parallel to the first leg 34—substantially in height direction H. Thereby the profile distance d can be adjusted.

The pivoting carrier 33 is pivotably supported on the machine frame 11 by means of a pivot support device 37. The pivot support device 37 of the first tool unit 12 defines a first pivot axis S1 and the pivot support device 37 of the second tool unit 13 defines a pivot axis S2. The pivot axes S1, S2 are orientated parallel to each other and extend in longitudinal direction L. According to the example, the pivot support device 37 connects the machine frame 11 with the pivoting carrier 33 in the connection area between the first leg 34 and the second leg 35 of the pivoting carrier 33.

Each tool unit 12, 13 comprises in addition a pivot drive 38 in order to adjust the pivot position of the respective pivoting carrier 33 around the respective pivot axis S1, S2. Each pivot drive 38 has a pivot drive motor 39 that can be configured as screw drive 40, controllable by means of the control device 27. A first wedge body 41 can be moved and according to the example, linearly shifted in longitudinal direction L by means of the pivot drive 38. The first wedge body 41 has a first bevel surface 42 that is inclined relative to the longitudinal direction L. The first bevel surface 42 extends without inclination in transverse direction Q according to the example. The pivoting carrier 33 and according to the example, the second leg 35 is supported at a support location 43 on the first bevel surface 42. The support location 43 is arranged with distance to the respective pivot axis S1 or S2 in transverse direction Q. For two-dimensional support a second wedge body 44 is arranged on the pivoting carrier 33 and according to the example, the second leg 35 in the embodiment. The second wedge body 44 has a second bevel surface 45 that is inclined relative to the longitudinal direction L. The second bevel surface 45 is without inclination in the transverse direction Q according to the example. The wedge angles of the first bevel surface 42 and the second bevel surface 45 have equal amounts. The second bevel surface 45 is in two-dimensional abutment against the first bevel surface 42. During shifting of the first wedge body 41 in longitudinal direction L by means of the pivot drive 28, the first bevel surface 42 and the second bevel surface 45 slide relative to each other.

By shifting of the first wedge body 41 in longitudinal direction L, the position of the support location 43 is moved in height direction H. Because the pivoting carrier 33 is pivotably supported via the pivot support device 37, a pivot movement around the respective pivot axis S1 or S2 is effected.

The pivoting carrier 33 can be pivoted around the respective pivot axis S1 or S2 by means of the pivot drive 38. Thereby also the slide support device 24 as well as the slide drive device 25 are pivoted and tilted together with the pivoting carrier 33 such that an inclination angle α is adjusted between the two cold rolling rack profiles 20 of the two cold rolling racks 19 in the plane spanned by the height direction H and the transverse direction Q. Preferably the control device 27 controls the pivot drives 38 of the two tool units 12, 13 thereby in a manner such that the same pivot angle amount around the first pivot axis S1 and the second pivot axis S2 is adjusted respectively. Related to a reference plane extending along the longitudinal axis A orthogonal to the height direction, both tool units 12, 13 or cold rolling racks 19 are arranged symmetrically.

A specific embodiment of the cold rolling machine 10 explained based on the block diagram according to FIG. 1 is illustrated in FIGS. 2-6. Particularly an embodiment for the configuration of the adjustment drive 36 and the pivot drive 38 is illustrated in these figures.

Figure 4:
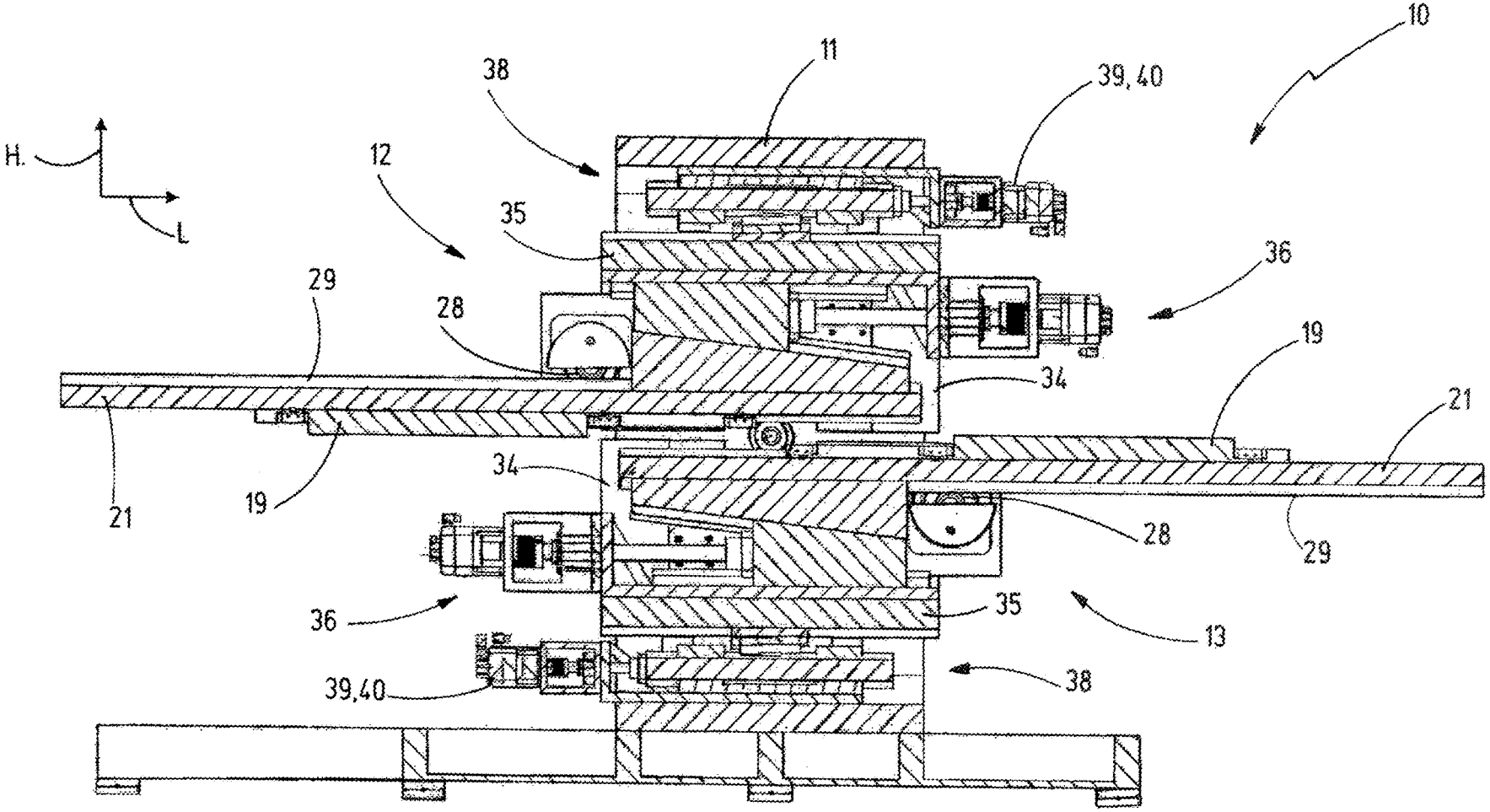
Figure 5:
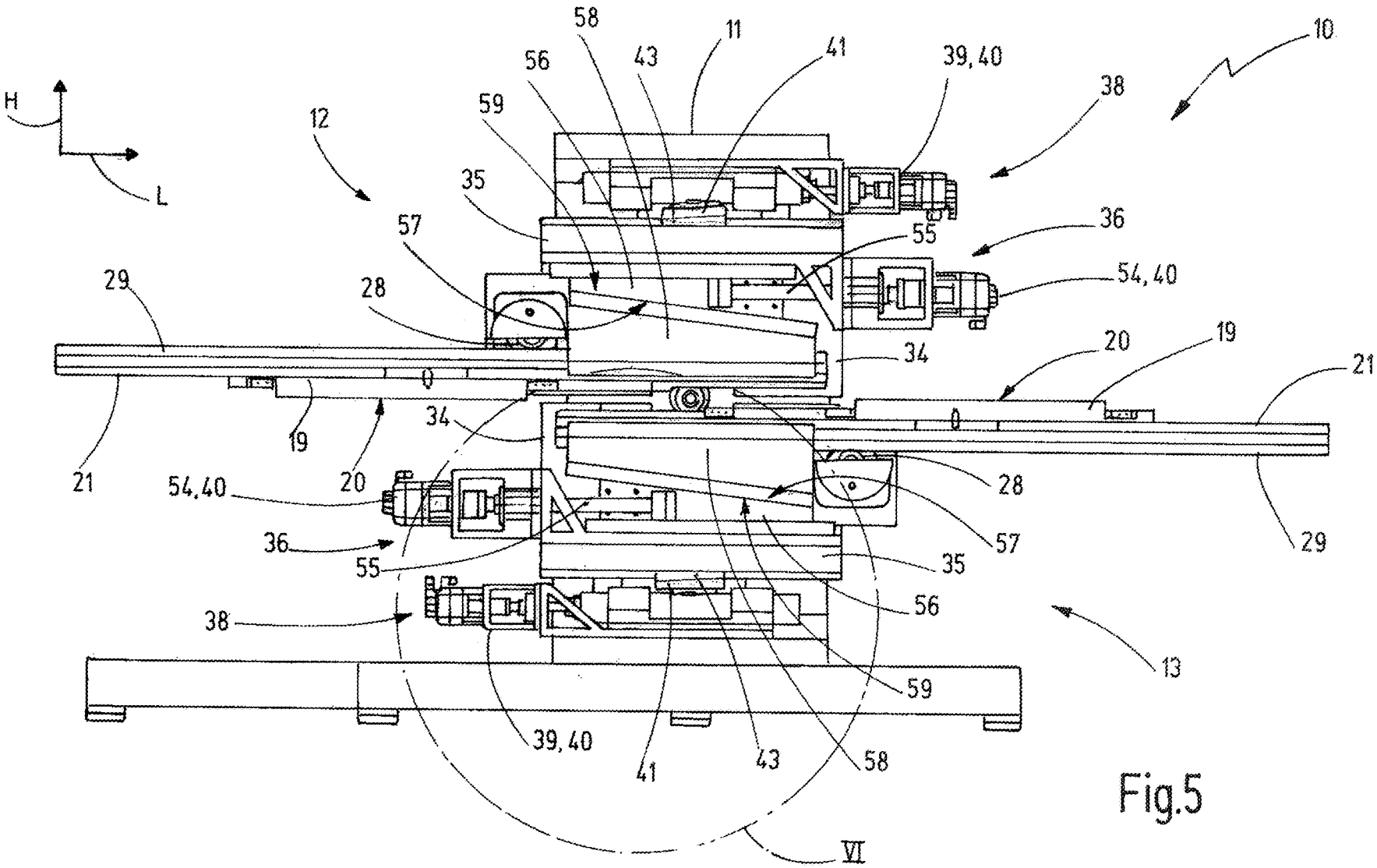
Figure 6:
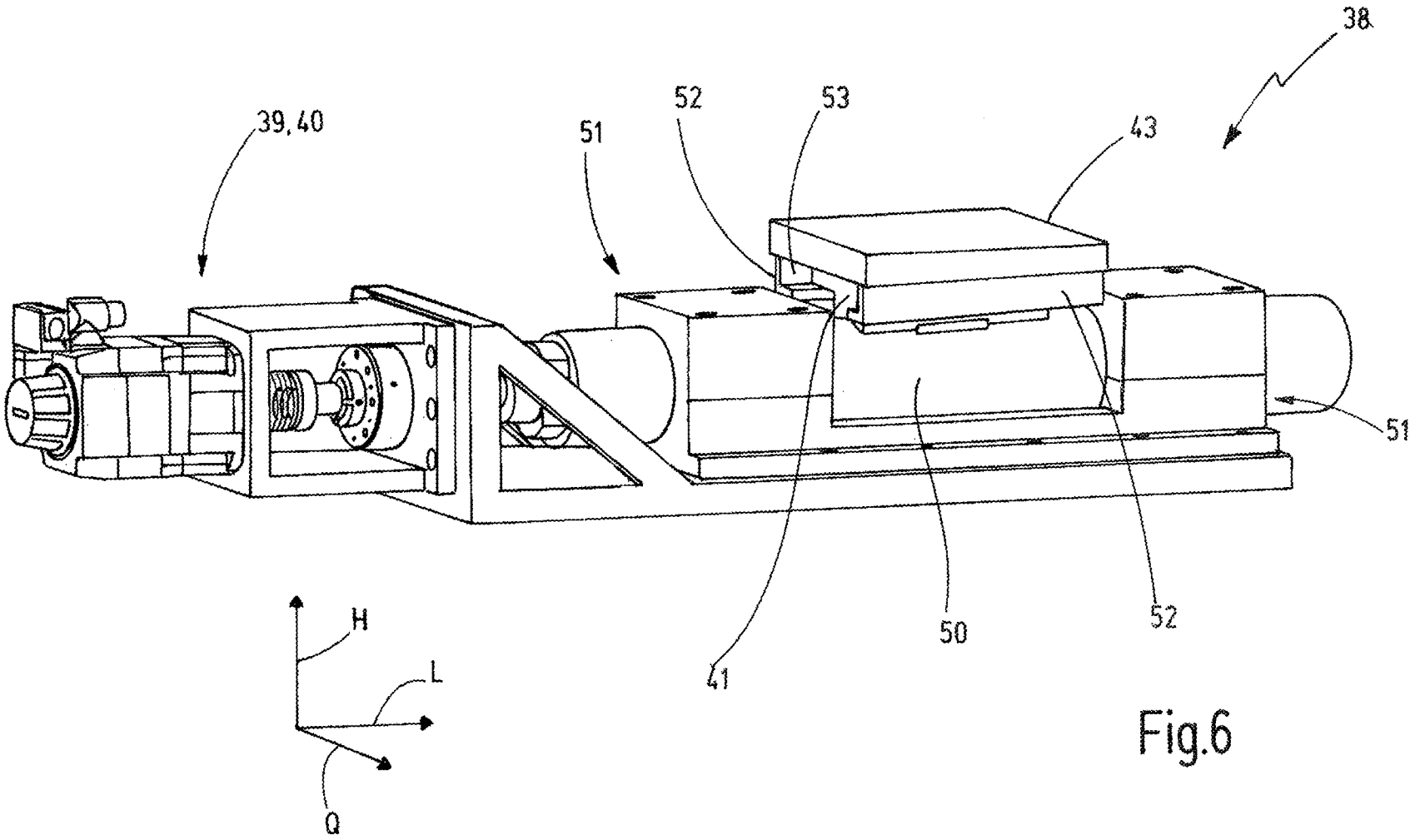

As particularly illustrated in FIGS. 4-6, each pivot drive 38 comprises a shank 50 that can be driven by the screw drive 40, e.g. a ball screw drive. The shank 50 is shiftably supported in longitudinal direction L on the machine frame 11 by means of a support 51. The first wedge body 41 is arranged in a manner to be movably coupled with the shank 50. For example, the first wedge body 41 can be connected with the shank 50 by means of screws and/or a key. During linear shifting of the shank 50 by means of the screw drive 40 a movement of the shank 50 is created in longitudinal direction L that also moves the first wedge body 41 in longitudinal direction L. Due to the support of the second wedge body 44 with its second bevel surface 45 on the first bevel surface 42 of the first wedge body 41, a movement of the second wedge body 44 in height direction H is carried out. Thereby the shank 50 is radially rotated in the support 51 in order to compensate for the inclination change of the pivoting carrier 33 with regard to the transverse direction Q. Due to the height change, also a cord in relation to the inclination angle α is changed. This length change is allowed due to a possible lateral shifting of the wedge bodies 41 and 44 in transverse direction Q relative to each other. Because the second wedge body 44 is arranged with distance to the respective pivot axis S1 or S2 on the pivoting carrier 33, the pivoting carrier 33 is pivoted around the respective pivot axis S1 or S2.

The wedge angle that the first bevel surface 42 and the second bevel surface 45 include relative to the longitudinal direction L have equal amounts and are smaller than 3 to 5 degrees according to the example. In the embodiment the wedge angles have an amount of about 2 degrees. In the embodiment described here a lift movement of the second wedge body 44 in height direction H of at most 1.5 mm can be carried out.

The configuration of the pivot drive 38 is self-locking such that a force acting on the pivoting carrier 33 in height direction H cannot initiate a movement of the first wedge body 41 in longitudinal direction L.

As apparent from FIG. 6, a guide recess 53 for the first wedge body 41 is formed on the second wedge body 43 by two guide rails 52 that are opposite to each other with distance in longitudinal direction. Each guide rail 52 can clasp an edge area of the first wedge body 41 for guiding of the first wedge body 41. An allowed transverse shift within the guide rails 52 is provided.

The adjustment drive 36 comprises a screw drive 40 that is driven by means of an adjustment drive motor 54. The screw drive can be configured as ball screw drive. The adjustment drive 36 is movably coupled with a third wedge body 56 in longitudinal direction L having a third bevel surface 57 that is inclined relative to the longitudinal direction L. The third wedge body 56 is movably arranged on the pivoting carrier in longitudinal direction L, according to the example via a plain bearing, and is supported on the second leg 35 according to the example. A fourth wedge body 58 has a fourth bevel surface 59 inclined with regard to the longitudinal direction L that abuts against the third bevel surface 57. The third and fourth bevel surfaces 57, 59 are not inclined in transverse direction Q according to the example.

The wedge angles of the third bevel surface 57 and the fourth bevel surface 59 relative to the longitudinal direction L have equal amounts such that a two-dimensional abutment between the third bevel surface 57 and the fourth bevel surface 59 is achieved. The wedge angles of the third bevel surface 57 and the fourth bevel surface 59 have an amount of at least 3 degrees and according to the example, 5-9 degrees, preferably about 7 degrees in the embodiment. During a movement of the third wedge body 56 in longitudinal direction L the third bevel surface 57 and the fourth bevel surface 59 slide relative to each other, whereby the fourth wedge body 58 is moved parallel to the first leg 34 of the pivoting carrier 33 and according to the example, substantially in height direction H. Depending on the pivot position of the pivoting carrier 33 about the pivot axis S1 or S2, the movement parallel to the first leg 34 is not exactly, but predominantly orientated in height direction H. At least it comprises a movement component in height direction such that the profile distance d can be adjusted. It is not relevant that thereby in addition a marginal movement of the cold rolling racks 19 is potentially effected in transverse direction Q. This marginal movement can be compensated by advancing the workpiece in transverse direction Q.

By means of the adjustment drive 36 and according to the example, by means of the movement of the fourth wedge body 58, the profile distance d between the two cold rolling racks 19 can be adjusted or varied prior to and/or during the creation of the profile in the workpiece 14.

Figure 7:
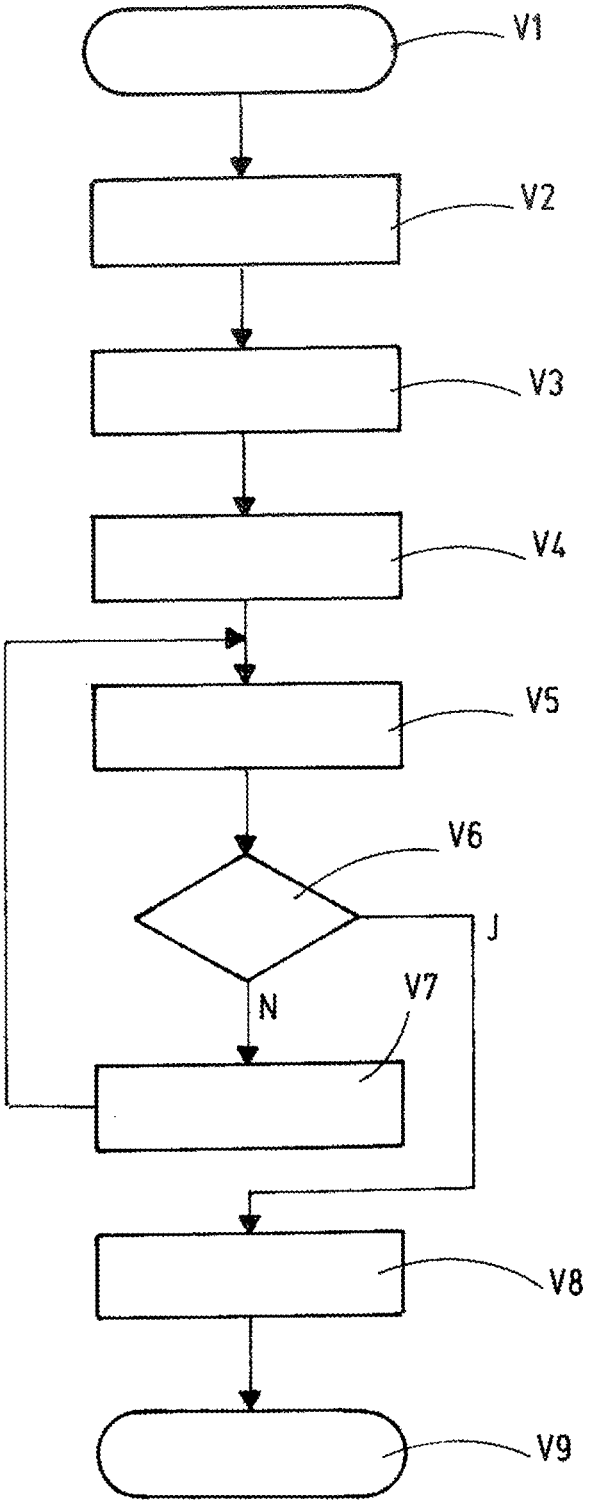

By means of the cold rolling machine 10 described above, a method can be carried out that is illustrated in FIG. 7.

In a first method step V1 a method is started. After the start an inclination angle α between the two cold rolling racks 19 is adjusted first in a second method step V2. In the simplest case the inclination angle α can be 0 degrees at first, such that the two cold rolling racks 19 or the two cold rolling rack profiles 20 are orientated parallel to each other. In addition, the profile distance d is adjusted by means of the adjustment drive 36.

In a third method step V3 a workpiece 14 to be profiled is arranged such that the section 15 to be profiled is placed between the two cold rolling racks 19 in height direction H and in transverse direction Q. Subsequently, an opposing movement of the two cold rolling racks 19 in longitudinal direction L is carried out by means of the respective slide drive devices 25 in a fourth method step V4. Thereby a movement of the cold rolling racks 19 in height direction H can be concurrently superimposed. During the movement of the cold rolling racks 19 in longitudinal direction L the respective cold rolling rack profile 20 is in engagement with the section 15 to be deformed of the workpiece 14 and forms the section 15 in its circumferential area, whereby a profile is created on the workpiece 14.

After the creation of the profile in the fourth method step V4, the workpiece 14 or at least the section 15 of the workpiece 14 provided with a profile is hardened. During hardening a conical deformation of the created profile can occur. For this reason subsequently the conicity of the created profile is determined in a sixth method step V6 and is compared with a predefined tolerance range. If the determined conicity of the profile is not within a predetermined tolerance range (junction N from the sixth method step V6), the inclination angle α is modified based on the determined conicity of the profile in a seventh method step V7 such that the conicity of a subsequently manufactured profile is within the tolerance range in consideration of the deformation during hardening. After the correction in the seventh method step V7, the method is continued in the fourth method step V4 according to the example, again with the creation of a profile and the re-measuring (method step V6).

Subsequently in the further method progress that is illustrated here by the eighth method step V8, one or more additional workpieces can be profiled in the cold rolling machine 10 with the adjusted inclination angle α and can be hardened subsequently. After the desired number of workpieces 14 has been profiled and hardened, the method ends in a ninth method step V9.

If it was determined in the sixth method step V6 that already the first profiled workpiece has a conicity of the profile after hardening that is within the tolerance range (junction J from the sixth method step V6), then the modification of the inclination angle α in the seventh method step V7 is skipped and the method is directly continued in the eight method step V8.

The present disclosure refers to a cold rolling machine 10 and a method for creating a profile on a workpiece 14. The cold rolling machine 10 has two preferably identically configured tool units 12, 13. Each tool unit 12, 13 has at least one cold rolling rack 19 extending in longitudinal direction L, a tool slide 21, a slide drive device 25, a pivoting carrier 33 and a pivot drive 38. At least one cold rolling rack 19 is attached to the tool slide 21 and can be moved in longitudinal direction L by means of the slide drive device 25. The pivoting carrier 33 can be pivoted around a pivot axis S1, S2 that extends in longitudinal direction L by means of the pivot drive 38. The tool slide 21 is arranged on the pivoting carrier 33. Thereby an inclination angle α can be adjusted between the two cold rolling racks 19 that can have an amount, for example, of 0 degrees to 0.5 degrees or 0.2 degrees. In doing so, conical profiles can be created in the workpiece 14 or process-related conical profiles can be compensated.

LIST OF REFERENCE SIGNS

10 cold rolling machine
11 machine frame
12 first tool unit
13 second tool unit
14 workpiece
15 workpiece section to be profiled
19 cold rolling rack
20 cold rolling rack profile
21 tool slide
22 support body
23 plain bearing element
24 slide support device
25 slide drive device
26 slide drive motor
27 control device
28 pinion
29 toothed rack
33 pivoting carrier
34 first leg
35 second leg
36 adjustment drive
37 pivot support device
38 pivot drive
39 pivot drive motor
40 ball screw drive
41 first wedge body
42 first bevel surface
43 support location
44 second wedge body
45 second bevel surface
50 shank
51 support
52 guide rail
53 guide recess
54 adjustment drive motor
55 threaded spindle
56 third wedge body
57 third bevel surface
58 fourth wedge body
59 fourth bevel surface
α inclination angle
A longitudinal axis
d profile distance
H height
L longitudinal direction
Q transverse direction
S1 first pivot axis
S2 second pivot axis
V1 first method step
V2 second method step
V3 third method step
V4 fourth method step
V5 fifth method step
V6 sixth method step
V7 seventh method step
V8 eighth method step
V9 ninth method step

The invention claimed is:

1. A cold rolling machine, comprising:

a machine frame, the machine frame having two tool units, wherein each tool unit comprises:

at least one cold rolling rack having a cold rolling rack profile and extending along a longitudinal direction, a tool slide that carries the at least one cold rolling rack and that is linearly movably supported in the longitudinal direction by a slide support device, a slide drive device that is configured to move the tool slide in the longitudinal direction, a pivoting carrier that is pivotably supported on the machine frame around a pivot axis and on which the slide support device and the tool slide with the at least one cold rolling rack is arranged, wherein the pivot axis extends in the longitudinal direction, and a pivot drive that is configured to pivot the pivoting carrier with the tool slide and the at least one cold rolling rack such that the cold rolling rack profile of the cold rolling rack includes an inclination angle in a plane orthogonal to the longitudinal direction.

2. The cold rolling machine according to claim 1, wherein a control device for controlling the pivot drive of each tool unit is provided and configured to pivot the pivoting carrier of each tool unit about a pivot angle and around the pivot axis.

3. The cold rolling machine according to claim 2, wherein the pivot drive of each tool unit comprises a first wedge body having a first bevel surface inclined relative to the longitudinal direction and wherein the pivoting carrier is supported on the first bevel surface at a support location that is arranged with distance to the pivot axis in the longitudinal direction to the pivot axis, wherein the first wedge body is movably supported in the longitudinal direction.

4. The cold rolling machine according to claim 3, wherein the pivot drive of each tool unit comprises a second wedge body having a second bevel surface inclined relative to the longitudinal direction, wherein the second wedge body is arranged on the pivoting carrier and wherein the second bevel surface abuts against the first bevel surface.

5. The cold rolling machine according to claim 4, wherein the first wedge body is arranged on a shank that is rotatably and linearly movably supported on the machine frame in the longitudinal direction.

6. The cold rolling machine according to claim 1, wherein the pivot drive of each tool unit comprises a first wedge body having a first bevel surface inclined relative to the longitudinal direction and wherein the pivoting carrier is supported on the first bevel surface at a support location that is arranged with distance to the pivot axis in the longitudinal direction to the pivot axis, wherein the first wedge body is movably supported in the longitudinal direction.

7. The cold rolling machine according to claim 6, wherein the pivot drive of each tool unit comprises a second wedge body having a second bevel surface inclined relative to the longitudinal direction, wherein the second wedge body is arranged on the pivoting carrier and wherein the second bevel surface abuts against the first bevel surface.

8. The cold rolling machine according to claim 6, wherein the first wedge body is arranged on a shank that is rotatably and linearly movably supported on the machine frame in the longitudinal direction.

9. The cold rolling machine according to claim 8, wherein the pivot drive of each tool unit comprises a screw drive that is configured to move the shank in the longitudinal direction.

10. The cold rolling machine according to claim 1, wherein a support body is movably supported in a height direction orthogonal to the longitudinal direction on the pivoting carrier.

11. The cold rolling machine according to claim 10, wherein the tool slide is movably supported on the support body in the longitudinal direction.

12. The cold rolling machine according to claim 10, wherein the slide drive device is movably supported on the pivoting carrier in the height direction together with the support body.

13. The cold rolling machine according to claim 10, wherein an adjustment drive moves the support body in the height direction relative to the pivoting carrier.

14. The cold rolling machine according to claim 13, wherein the adjustment drive comprises a third wedge body having a third bevel surface inclined relative to the longitudinal direction that is movably supported on the pivoting carrier and on which the support body is supported.

15. The cold rolling machine according to claim 14, wherein a fourth wedge body having a fourth bevel surface inclined relative to the longitudinal direction is arranged on the support body, wherein the fourth bevel surface abuts against the third bevel surface.

16. The cold rolling machine according to claim 1, wherein the slide drive device comprises a driveable pinion and a toothed rack in engagement with the pinion, wherein the toothed rack extends in the longitudinal direction and is arranged on the tool slide.

17. A method for creating a profile on a workpiece by using the cold rolling machine according to claim 1, comprising the following steps:

adjusting an inclination angle between the cold rolling rack of each tool unit in the plane orthogonal to the longitudinal direction, arranging of a section to be profiled of the workpiece between the cold rolling rack of each tool unit, and moving the cold rolling rack of each tool unit opposite to one another in the longitudinal direction, wherein the cold rolling rack profile of each tool unit deform the section to be profiled of the workpiece.

18. The method according to claim 17, wherein the section of the workpiece provided with the profile is hardened.

19. The method according to claim 17, wherein a conicity of the profile is determined and compared with a tolerance range directly after creation or after hardening of the workpiece and that the inclination angle is changed, if the determined conicity is not within the tolerance range.

20. The method according to claim 18, wherein a conicity of the profile is determined and compared with a tolerance range directly after creation or after hardening of the workpiece and that the inclination angle is changed, if the determined conicity is not within the tolerance range.

* * * * *